US008647220B2

(12) United States Patent
Lloyd

(10) Patent No.: US 8,647,220 B2
(45) Date of Patent: Feb. 11, 2014

(54) BASKETBALL TRAINING DEVICE

(76) Inventor: Luke Christopher Lloyd, Flint, MI (US)

( * ) Notice: Subject to any disclaimer, the term of this patent is extended or adjusted under 35 U.S.C. 154(b) by 143 days.

(21) Appl. No.: 12/985,531

(22) Filed: Jan. 6, 2011

(65) Prior Publication Data

US 2011/0294606 A1 Dec. 1, 2011

Related U.S. Application Data

(60) Provisional application No. 61/348,351, filed on May 26, 2010.

(51) Int. Cl.
*A63B 69/00* (2006.01)

(52) U.S. Cl.
USPC ..... 473/422; 473/447

(58) Field of Classification Search
USPC ..... 473/454, 450, 422, 417, 447; 439/215; 403/396; 248/454, 205.1, 185.1, 156, 248/122.1; 211/85.7, 27, 190, 182; 52/36.5, 52/36.6
See application file for complete search history.

(56) References Cited

U.S. PATENT DOCUMENTS 1,038,198 A * 9/1912 Randall et al. ..... 211/205
2,262,939 A * 11/1941 Howard ..... 248/188.5
2,345,650 A * 4/1944 Attwood ..... 403/21
3,178,775 A * 4/1965 Tassell ..... 52/474
3,186,561 A * 6/1965 Strassle ..... 211/182
3,451,183 A * 6/1969 Lespagnol et al. ..... 52/656.1
3,574,367 A * 4/1971 Jankowski ..... 403/201
4,163,537 A * 8/1979 Mourgue ..... 248/188.1
4,641,983 A * 2/1987 Strassle ..... 403/12
4,805,365 A * 2/1989 Bastian ..... 52/282.2
4,997,001 A * 3/1991 DiCarlo ..... 135/65
5,864,997 A * 2/1999 Kelly ..... 52/282.2
6,179,511 B1 * 1/2001 Gassler ..... 403/322.1
2011/0294606 A1 * 12/2011 Llyod ..... 473/422

OTHER PUBLICATIONS

Webpage download, CarrLane,2006,www.carrlane.com, 7 pages.*
Webpage download, Techni-Tool, 2005,web.archive.org/web/20050208125657/http://www.techni-toolproducts.com/ad03.htm, 1 page.*

* cited by examiner

*Primary Examiner* — Gene Kim
*Assistant Examiner* — M Chambers
(74) *Attorney, Agent, or Firm* — Gifford, Krass, Sprinkle, Anderson & Citkowski, P.C.

(57) ABSTRACT

A basketball training device having at least one elongated and vertically extending post with at least two longitudinally spaced openings. At least one elongated arm has one end insertable into one of the spaced openings on the post so that the arm extends horizontally outwardly from the post. A basketball player practices dribbling by dribbling both under the arm and over the arm as desired.

1 Claim, 4 Drawing Sheets

BASKETBALL TRAINING DEVICE

CROSS REFERENCE TO RELATED APPLICATIONS

This application claims priority of U.S. Provisional Patent Application Ser. No. 61/348,351 filed May 26, 2010, which is incorporated herein by reference.

BACKGROUND OF THE INVENTION

I. Field of the Invention

The present invention relates generally to sports training devices and, more particularly, to a basketball training device.

II. Description of Related Art

In the sport of basketball, proper dribbling is imperative to master the game. In order to dribble properly, a skilled basketball player must be able to both dribble low to avoid defensive arms of the opposing team as well as a power dribble to dribble over the arms of a defensive player. Furthermore, in order to develop proper ball control skills it is necessary for the player to practice dribbling at multiple heights and multiple angles and also to develop the proper footwork.

To date, there have been no previously known basketball training devices for teaching proper dribbling skills in various different defensive situations. As such, it is difficult and time consuming for players for develop the proper dribbling skills.

SUMMARY OF THE PRESENT INVENTION

The present invention provides a basketball training device which overcomes the above-mentioned disadvantages by providing a training device for dribbling skills and ball control.

In brief, the device of the present invention includes at least one elongated and vertically extending post. The post includes at least two, and preferably more, longitudinally spaced openings.

At least one elongated arm has one end insertable into the spaced opening so that the arm extends horizontally outwardly from the post. Using different openings in the post provides the outwardly extending arm at different heights.

With the arm attached to the post at the desired vertical height, the basketball player can then practice dribbling, ball control, and footwork not only under the outwardly extending arm, but also over the outwardly extending arm in a power dribble. Furthermore, the training device of the present invention provides instantaneous training feedback for a basketball player such that the basketball player is able to improve his or her skills at a rapid pace.

Any conventional mechanism may be utilized to detachably secure the arm to the post. However, in one configuration the post is formed by an outer tube having a plurality of longitudinally spaced openings and an inner member, also preferably a tube, which is longitudinally slidably mounted in the outer tube. The inner member also includes openings which register with the tube openings at predefined longitudinal positions of the member relative to the tube. A spring is then disposed between the tube and the member which urges the member to a position longitudinally offset from the predetermined position in which the openings in the tube and member register with each other.

In practice, the inner member is longitudinally displaced until the openings in the member and the tube register with each other. At that time, one end of the arm is disposed through the registering openings. Upon release of the inner member, the spring urges the inner member against the arm thus locking the arm to the post. The arm may be moved, of course, by longitudinally displacing the inner member to release the force of the spring from the arm and then withdrawing the arm from the registering openings. Thereafter, the arm may be repositioned through a different set of registering openings in the member in order to change the height of the arm.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
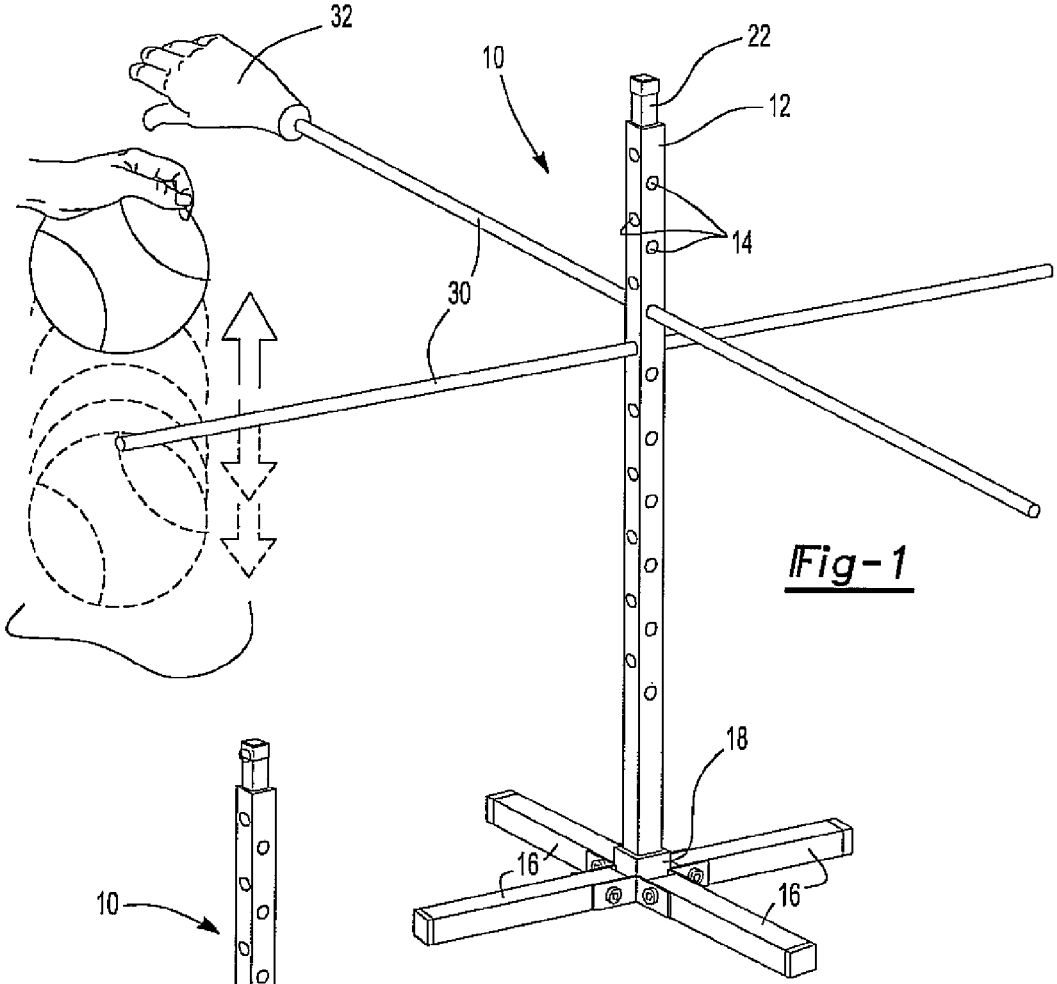
FIG. 1 is an elevational view illustrating a first preferred embodiment of the present invention.
Figure 2:
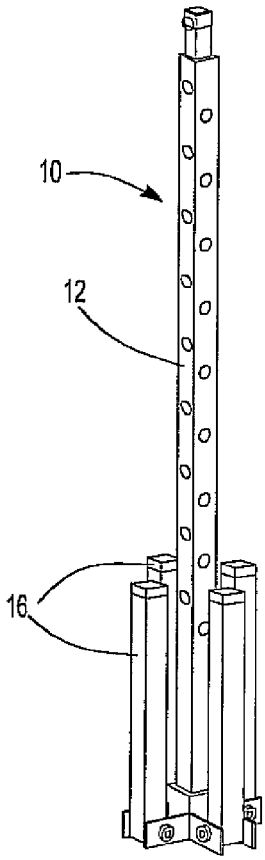
FIG. 2 is a view similar to FIG. 1, but illustrating the training device in a storage position.

With reference first to FIGS. 1 and 2, a first preferred embodiment of a basketball training device 10 according to the present invention is shown. The training device 10 includes an elongated and vertically extending post 12 having a plurality of longitudinally spaced openings 14 along its length.

At least three legs 16 are pivotally mounted to a lower end 18 of the post 12. These legs are pivotal between an operable position, shown in FIG. 1, and a storage position, shown in FIG. 2. In its operable position (FIG. 1) the legs 16 support the post 12 so that it extends vertically upwardly from a ground support surface. Conversely, in its storage position (FIG. 2) the legs 16 are folded against the post 12 for compact storage.

Figure 3:
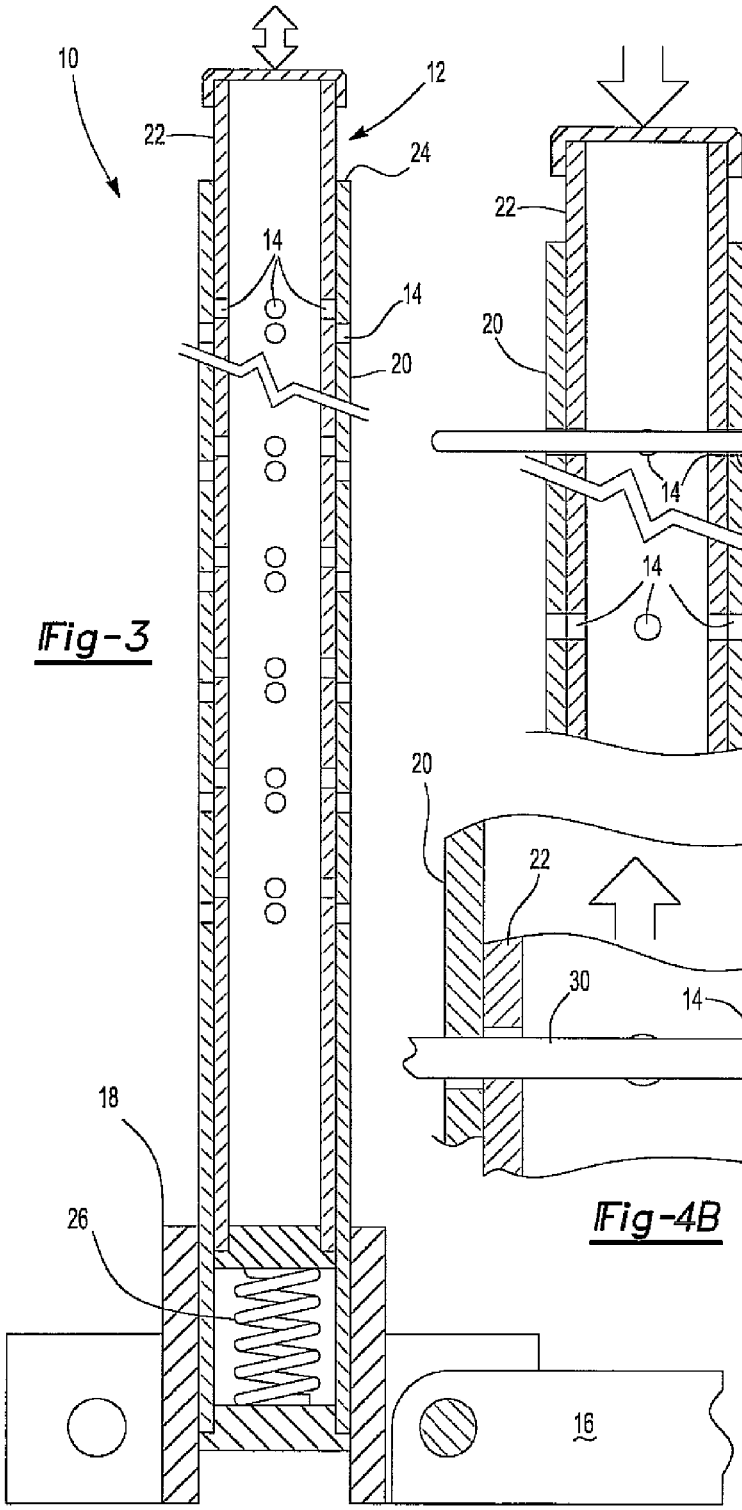
FIG. 3 is a longitudinal sectional view illustrating the training device.

With reference now to FIG. 3, the post 12 is there shown in greater detail and includes a tube 20 which is preferably rectangular in cross-sectional shape. An inner member 22, which may also comprise a rectangular tube, is longitudinally slidably disposed within the tube 20. Furthermore, the member 22 preferably extends upwardly above a top 24 of the tube 20 so that it is manually accessible.

The member 22 also includes a plurality of openings 26 which register with the openings 14 in the tube 20 at a predetermined longitudinal position of the member 22 relative to the tube 20. However, a compression spring 26 is operatively disposed between the tube 20 and member 22 which urges the member 22 to a longitudinal position offset from the predetermined position in which the openings in the member 22 and tube 20 register with each other. However, the openings in the member 22 can be brought into alignment with the openings 14 in the tube 20 by pressing the member 22 downwardly against the force of the compression spring 26.

Figure 4A:
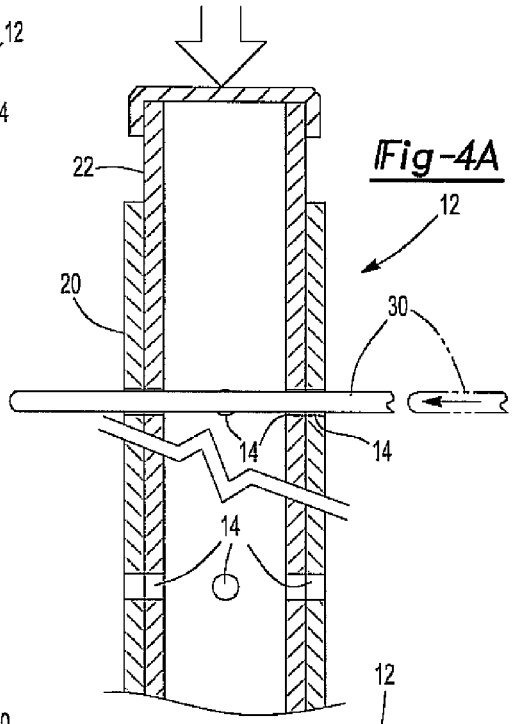
FIGS. 4A and 4B are fragmentary sectional views illustrating the operation of the present invention.
Figure 4B:
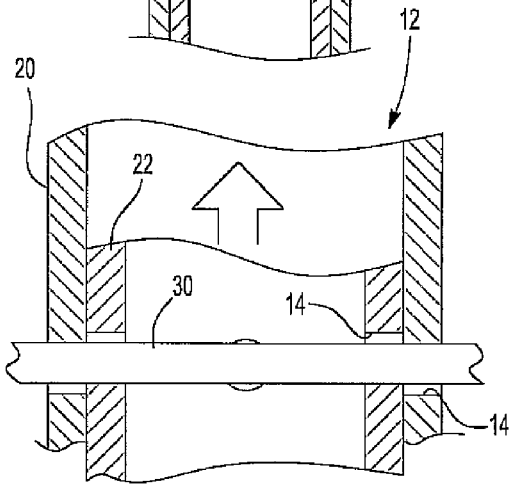

With reference now to FIGS. 1, 4A and 4B, at least one elongated arm 30 is detachably secured to the post 12 so that the arm 30 extends laterally or generally horizontally outwardly from the post 12. Although any conventional means may be used to attach the arm 30 to the post 12, one preferred attachment mechanism is best illustrated in FIGS. 4A and 4B.

With reference then to FIGS. 4A and 4B, the member 22 is first depressed downwardly against the force of the compression spring 26 until the openings 14 in the tube 20 register with the openings 23 in the inner member 22. At this time, one end of the arm 30 is inserted through the registering openings in the tube 20 and member 22.

After insertion of the arm 30, the inner member 22 is then released. Upon release, the spring 26 (FIG. 3) urges the member 22 upwardly to the position shown in FIG. 4B in which the arm 30 is compressibly trapped between the member 22 and tube 20. In the event that adjustment of the height of the arm 30 is desired, the member 22 is simply slightly depressed to the position shown in FIG. 4A, the arm 30 removed and reinserted through a different set of registering openings 14 and 23 and the inner member 22 released again to the position shown in FIG. 4B.

Consequently, not only may the vertical height of the arm 30 be adjusted along the post 12, but multiple arms 30 may be also be attached to a single post as shown in FIG. 1. For added realism, a model of a hand 32 may be attached to the free end of the arm 30.

With one or more arms 30 attached to the post 12, the basketball player may practice his or her dribbling skills, ball control, and footwork by dribbling not only under the arms 30, but also by a power dribble over the arms 30. Different heights of the arms 30 will accommodate different heights of players.

Figure 5:
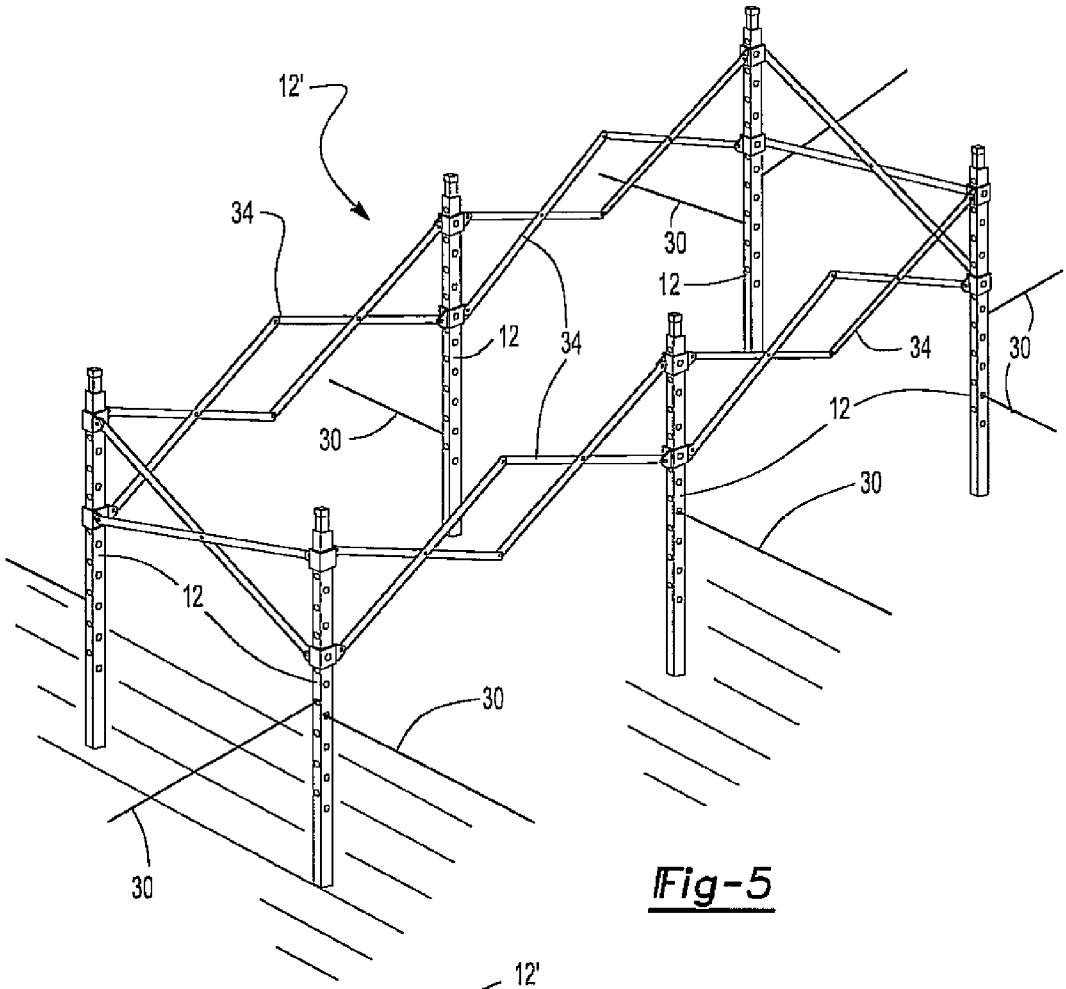
FIG. 5 is a view similar to FIG. 1, but illustrating a modification thereof.

With reference now to FIG. 5, a modification of the basketball training device 12' is shown. In this modification of the training device, multiple posts 12 are attached together by scissor connectors 34. Although the modified basketball training device 12' is illustrated in FIG. 5 as containing six posts 12, it will be understood that the modified training device 12' may have any number of posts 12 greater than three.

The posts 12, as well as the arms 30, are substantially the same as shown in FIG. 1 so that a further description thereof is unnecessary. However, the multiple post training device 12' may eliminate the leg 16 used in the single post training device 12 (FIG. 1).

The multi-post training device 12' enables a basketball player to develop dribbling, footwork, and ball control skills by dribbling past successive arms 30 which may be at the same or different heights. The multi-post training device 12' also allows two or even more basketball players to train simultaneously.

Figure 6:
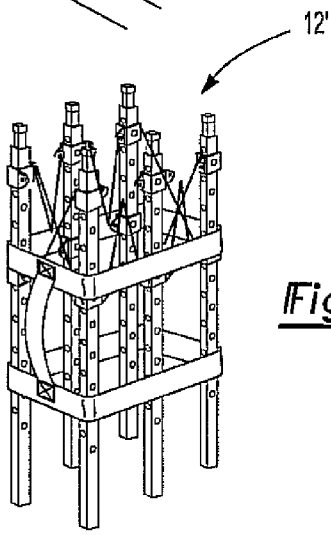
FIG. 6 is an elevational view illustrating the training device in a collapsed storage position.

With reference now to FIGS. 5 and 6, when the multi-post training device 12' is no longer desired for practice, the scissor connectors 34 allow the training device 12' to be collapsed to the position shown in FIG. 6 in which the posts 12 are closely adjacent each other. The collapsed training device 12' is then ready for compact storage.

Figure 7:
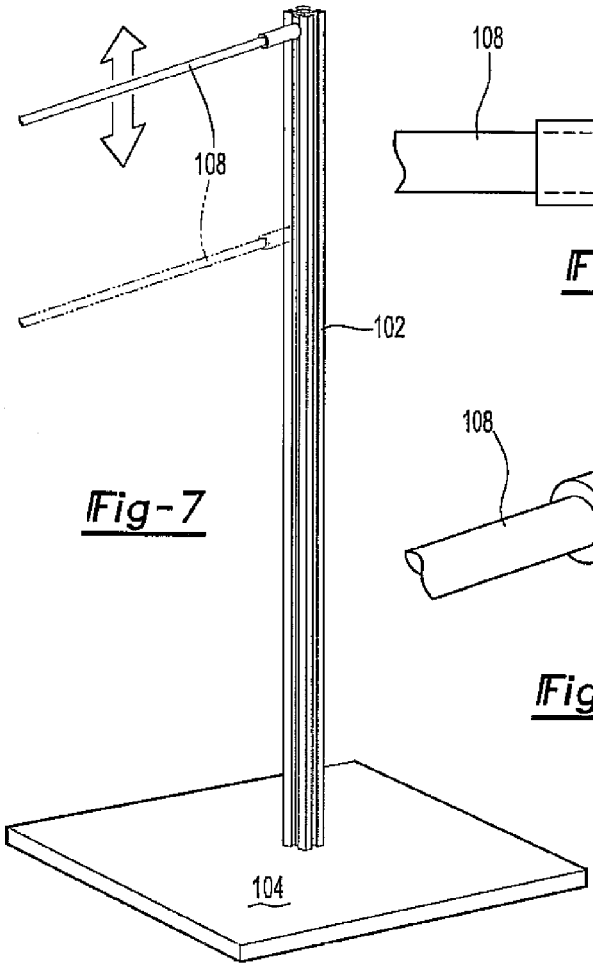
FIG. 7 is an elevational view illustrating a second embodiment of the present invention.
Figure 8:
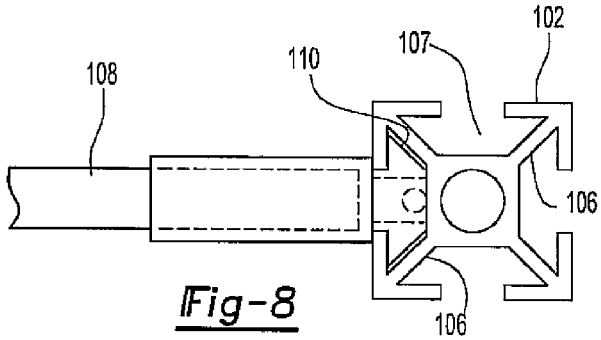
FIG. 8 is a top view of the second embodiment.
Figure 9:
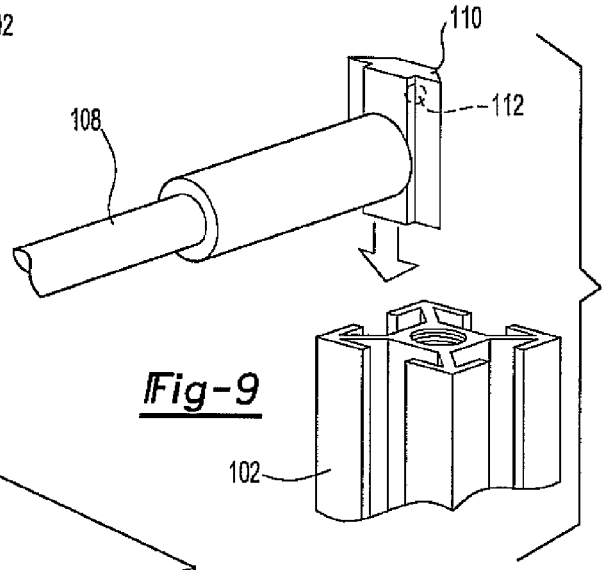
FIG. 9 is an exploded view illustrating a portion of the second embodiment.

With reference now to FIGS. 7-9, a second preferred embodiment of a basketball training device 100 is shown. The training device 100 includes an elongated and vertically extending post 102 which is supported in a vertically extending position by a base 104. Other means, such as support legs, may be utilized in lieu of the base 104.

As best shown in FIGS. 8 and 9, the post 102 includes at least one, and preferably four vertically extending slots 106 which extend from the top of the post 102 and towards its bottom. Each slot 106, furthermore, is open to a trapezoidal channel 107 having cross-sectional area greater than the slot 106. Preferably a single slot 106, and channel 107 are formed on each side of the post 102.

An elongated arm 108 includes a lock member 110 attached to one end of the arm 108. The lock member 110 is also trapezoidal in shape and dimensioned so that it is slidably received within one of the channels 107 while the 108 extends outwardly through the slot 106. Furthermore, as shown in FIG. 1, the vertical position of the arm 108 may be adjusted from the position shown in solid line and to the position shown in phantom line by merely sliding the lock member 110 in its associated channel 107.

Figure 10:
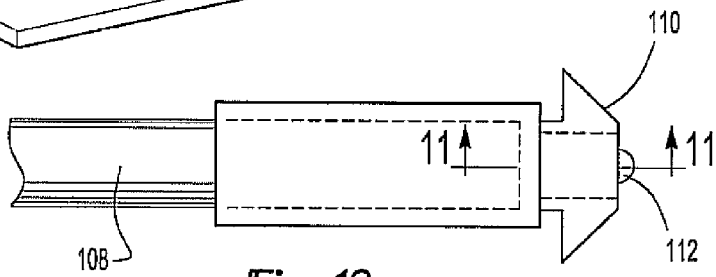
FIG. 10 is a top view showing a portion of the second embodiment of the invention.
Figure 11:
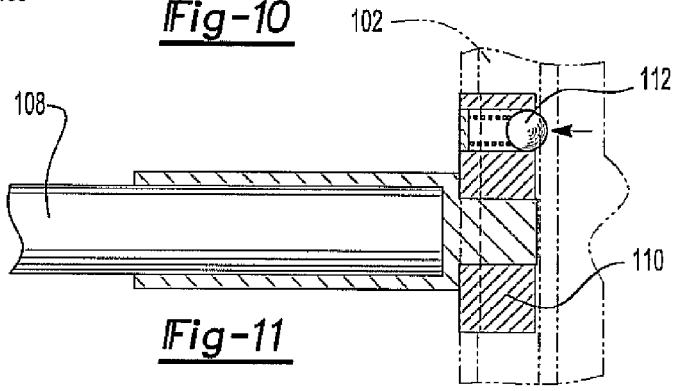
FIG. 11 is a view taken along line 11-11 in FIG. 10.

With reference now to FIGS. 10 and 11, the locking arm 108 will naturally lock itself to the post 102 in its vertically adjusted position by the weight of the arm 108 causing the lock member 110 to wedge within its receiving channel 107. However, in order to more firmly engage the lock member with the post, a spring loaded detent 112 is preferably mounted in the lock member 110. The detent 112 urges the lock member 110 against the post thus providing a firm, but releasable, lock between the lock member 110 and the post 102.

From the foregoing, it can be seen that the present invention provides a simple and yet effective basketball training device to teach and improve dribbling skills, ball control, and footwork. Having described our invention, however, many modifications thereto will become apparent to those skilled in the art to which it pertains without deviation from the spirit of the invention as defined by the scope of the appended claims.

I claim:

1. A basketball training device comprising:

an elongated and vertically extending post having a vertically extending slot on at least one side, said slot open to a channel have a greater cross-sectional area than said slot, and said post having an inner surface aligned with said slot, an elongated arm, a lock member attached to one end of said arm, said lock member having a cross-sectional area greater than said slot and dimensioned to be slidably received in said channel, wherein said channel and said lock member are both trapezoidal in cross-sectional shape, said lock member being smaller in cross-sectional shape than said channel, and a spring and a ball detent mounted in a bore in said lock member at a position offset from said rod, so that said spring urges said ball detent against said inner surface of said post to thereby lock said lock member to said post and wherein said vertically adjusted rods provide a dribbling barrier for basketball players when training to go either over or under.

* * * * *